United States Patent [19]

Craver

[11] Patent Number: 4,603,683

[45] Date of Patent: Aug. 5, 1986

[54] FIREPLACE INSERT

[75] Inventor: Richard D. Craver, Orrville, Ohio

[73] Assignee: Orrville Products, Inc., Orrville, Ohio

[21] Appl. No.: 794,278

[22] Filed: Nov. 4, 1985

Related U.S. Application Data

[63] Continuation of Ser. No. 613,218, May 23, 1984, abandoned.

[51] Int. Cl.[4] ..... F24C 15/12

[52] U.S. Cl. ..... 126/138; 126/190

[58] Field of Search ..... 126/123, 163 R, 163 A, 126/121, 126, 135, 136, 138, 139, 120, 190, 200

[56] References Cited

U.S. PATENT DOCUMENTS

| | | | |
|---|---|---|---|
| D. 261,922 | 11/1981 | Mariager et al. | D23/95 |
| D. 262,135 | 12/1981 | Halls | D23/94 |
| D. 262,308 | 12/1981 | Christophel | D23/94 |
| D. 264,496 | 5/1982 | Larsen | D23/93 |
| D. 264,621 | 5/1982 | Becker, Jr. | D23/94 |
| D. 265,237 | 6/1982 | Beck et al. | D23/94 |
| D. 272,176 | 1/1984 | Chastain, Jr. | D23/93 |
| 4,305,373 | 12/1981 | Martenson | 126/121 |
| 4,354,480 | 10/1982 | Henderson et al. | 126/123 |
| 4,375,803 | 3/1983 | Love | 126/121 |
| 4,381,760 | 5/1983 | Reges | 126/138 |
| 4,441,482 | 4/1984 | Lascombe | 126/123 |
| 4,461,274 | 7/1984 | Cauffman | 126/163 R |

*Primary Examiner*—William E. Lyddane
*Assistant Examiner*—Gerald A. Anderson
*Attorney, Agent, or Firm*—Body, Vickers & Daniels

[57] ABSTRACT

An improvement in a conversion insert for an existing fireplace cavity of the type having a back wall and outwardly diverging lateral walls providing an access opening. The insert has the normal sheet metal housing with a face plate extending transversely outwardly from the side walls of the housing to form a closure over the access opening in the fireplace. In the improvement, the spaced side walls diverge outwardly from the sheet metal rear wall of the housing to form a relatively large charging opening spaced from the fireplace cavity itself. In addition, there is provided an outwardly protruding convex, exposed front wall extending across the front of the large charging opening to the spaced edges of the face plate so as to block the face plate from view and to create relatively large compartments for blowers and other accessories.

1 Claim, 3 Drawing Figures

FIREPLACE INSERT

This is a continuation of Ser. No. 613,218 filed May 23, 1984 now abandoned.

The present invention relates to the art of wood and coal burning stoves and more particularly to a conversion insert for converting a fireplace to a coal or wood burning stove for the purpose of providing heat as well as the asthetic value of a fireplace itself. In recent years, substantial advances have been made in freestanding stoves used to burn wood and/or coal for the purpose of providing auxiliary heating. These stoves are intended to be both a heating device and a decorative accessory for living quarters. Such stoves offer an alternative to natural gas furnaces and other standard forced air or convection heating systems for domestic use. Many homes built within the last half century have included fireplaces which, by and large, are only decorative and allow substantial heat energy loss in homes. These two facts together with the continuously rising natural gas prices, have caused many stove manufacturers to provide a wood and/or coal burning stove which will actually fit into and occupy the same space as an existing fireplace. Such stoves are known as fireplace inserts or conversion inserts and are used to convert a heat loss fireplace into an efficient source of auxiliary heat for the living quarters. Such inserts use the existing fireplace chimney which substantially reduces the cost of installation. These inserts convert fireplaces into stoves and employ blowers and heat exchangers to draw air from a room, heat the air and, then, discharge the heated air back into the room. Wood or coal being burned in the insert is burned efficiently by both primary and secondary air flows so that the actual products of combustion are burned fully. Consequently, increased use of the fireplace does not cause build-up of cresote in the fireplace chimney. These conversion inserts have been quite successful and are now widely used.

One disadvantage of the inserts now on the market is that they destroy the appearance of the fireplace, which was originally intended as an integrated decorative area of a room. When an insert is used to convert the fireplace to a stove with the necessary forced air mechanisms, the fireplace loses its asthetic value. Consequently, the fireplace insert distracts from the overall appearance of the room in which it is located. In addition, in view of the tapered structure of the existing fireplace cavity, the access opening to the stove portion of the insert is quite small. Indeed, often it is a single door of the type normally used for freestanding stoves of the wood burning or coal burning type. To obtain the advantage of a stove to take the place of a fireplace, the original function of the fireplace is essentially preempted.

This discussion relates to the prior art to which the present invention is directed.

THE INVENTION

The disadvantages noted above for fireplace inserts have been overcome by the present invention which provides a fireplace conversion insert which has a large flat opening irrespective of the constraints of the fireplace cavity and provides a structure which resembles more the asthetic value of a fireplace as opposed to the stark structure of a wood burning or coal burning, freestanding stove.

In accordance with the present invention, there is provided an improvement in a conversion insert for use with an existing fireplace cavity of the type having a back wall with outwardly diverging lateral walls defining an access opening with a preselected width. These inserts, in the past, comprised a sheet metal housing having a rear wall, spaced side walls extending outwardly from the rear wall and defining a charging opening therebetween and a face plate extending transversely outwardly from the side walls of the housing to form a closure over the access opening of the fireplace when the insert is positioned in the fireplace cavity. The laterally extending face plate or plates have outboard, generally parallel edges spaced from each other a distance substantially greater than the preselected width of the access opening to cover this opening. The improvement of the present invention comprises extending outwardly the spaced side walls of the insert housing so that they extend beyond the fireplace cavity a substantial distance. This distance is outwardly from the face plate so that the charging opening of the insert housing is spaced outwardly from the face plate and is between the outer edges of the side walls. This enlarges the stove portion of the insert and provides more radiant heat to the surrounding air. Lack of such radiating, exposed surfaces is a disadvantage of most prior fireplace inserts. An outwardly protruding convex, exposed front wall extends around the insert in a path defined by the outward edges of the face plate and the outer edges of the side walls extending beyond the face plate. The exposed front wall is a continuous structure provided with two pivoted sections between the edges of the side plates at the charging opening to define door means for controlling access to the charging opening of the insert housing. In this manner, the charging opening remains as large as, or larger than, the fireplace cavity and the front wall covers both the outwardly extending face plate and the outwardly protruding edges of the side walls. By providing this structure, the stove portion is enlarged beyond the fire portion of the fireplace. This provides a fire box extension for efficient heating. The outwardly protruding, convex exposed front wall can be provided with decorative panels or other structures resembling a large fireplace structure. The asthetic value of a fireplace is retained and, indeed, enhanced by the structural features of the improved fireplace insert. A small inefficient fireplace is converted to a large fireplace with the attributes of a freestanding stove.

In accordance with another aspect of the present invention, the spaced side walls of the insert diverge outwardly so that the charging opening is substantially larger than the actual fireplace opening. This provides substantial flexibility in using the insert itself as a fireplace while still retaining the stove features. Prior attempts to accomplish this have not been extremely successful in that they have, at best, placed transparent windows on the insert to allow viewing of the internal hearth. The present invention allows for the actual appearance of a fireplace, increases the fireplace size and allows side visability of the interior fire.

The primary object of the present invention is the provision of a fireplace insert which is easy to build and combines the heat efficiency and alternative fuel aspects as a wood or coal burning stove while also providing the decorative function of a fireplace.

Another object of the present invention is the provision of a fireplace insert, as defined above, which provides an efficient fireplace larger than an existing fireplace.

Still a further object of the present invention is the provision of a fireplace insert, as defined above, which insert has sufficient compartments for implementation of a blower system which does not distract from the shape or appearance of the insert.

These and other objects and advantages will become apparent from the following description of the preferred embodiment of the invention employing drawings to be described hereinafter.

BRIEF DESCRIPTION OF DRAWINGS

In the present disclosure, the preferred embodiment is shown in the following drawings.

PREFERRED EMBODIMENT

Figure 2:
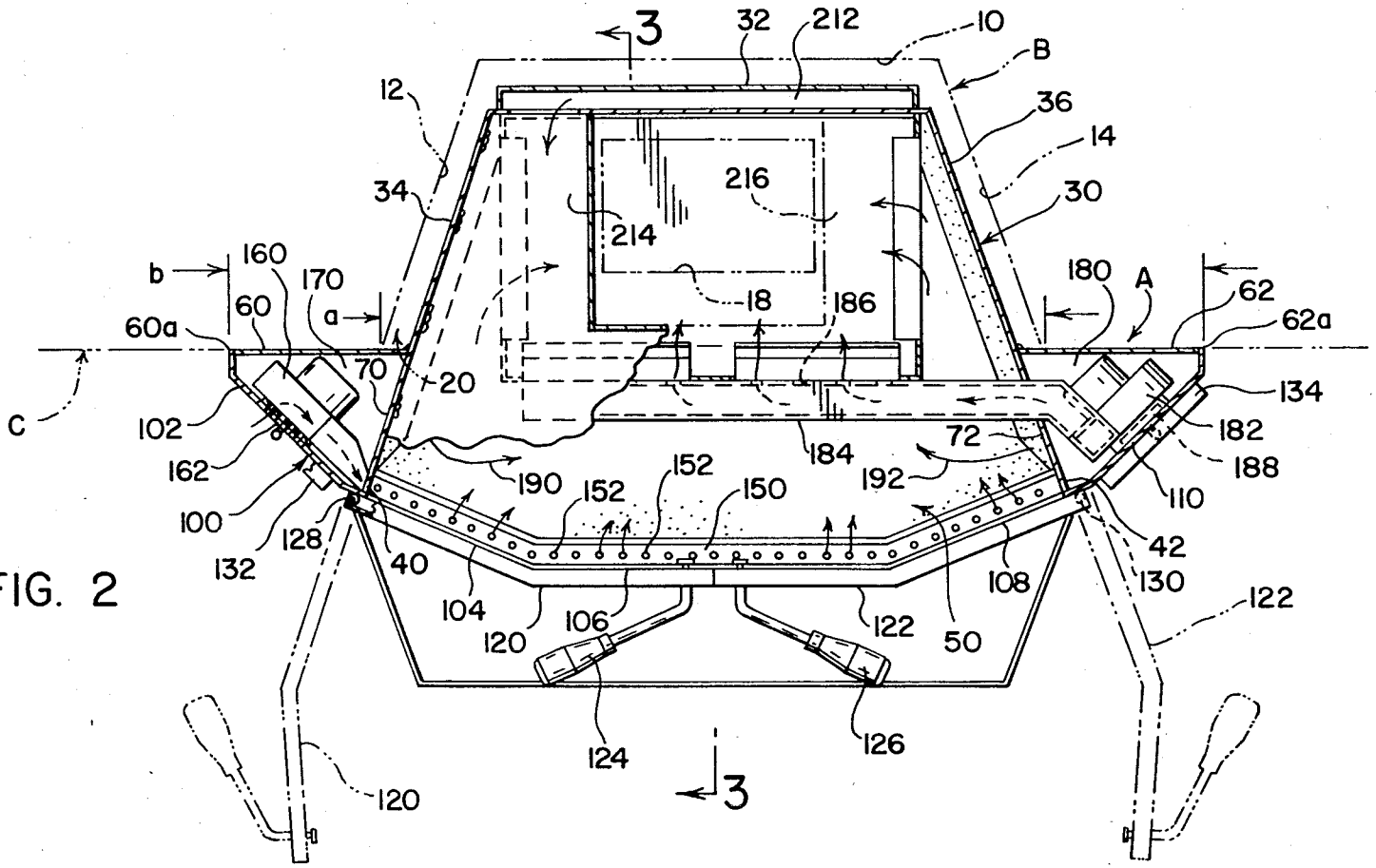
FIG. 2 is a cross sectional view of the preferred embodiment, as shown in FIG. 1, taken generally along line 2—2 with certain phantom line features and cut away portions for illustrative purposes; and, FIG. 3 is a cross sectional view of the preferred embodiment of the invention taken generally along line 3—3 of FIG. 2.

Referring now to the drawings wherein the showings are for the purpose of illustrating a preferred embodiment of the invention only, and not for purposes of limiting same, a fireplace conversion insert A constructed in accordance with the present invention is mounted into a standard fireplace cavity B terminating in an outer structural wall C. In accordance with standard structure, fireplace cavity B is lined with refractory material, such as fire bricks, and includes a back wall 10, outwardly diverging lateral walls 12, 14 and a top or ceiling 16. A flue structure D, not shown in detail, connects fireplace conversion insert A with the standard chimney structure (not shown) by an appropriate extension or pipe 18, shown in phantom lines. Cavity B has an outwardly facing access opening 20 with a preselected width a, shown in FIG. 2. This preselected width varies; however, it is generally formed by outwardly diverging lateral walls 12, 14. The preferred embodiment of the invention includes a sheet metal housing 30 having an integral structure, including rear wall 32, spaced side walls 34, 36, diverging outwardly, as shown in FIG. 2. The extremities of side walls 34, 36 are laterally spaced parallel edges 40, 42 which generally define charging opening 50. This opening is larger than access opening 20 of the original fireplace. To cover access opening 20, face plates 60, 62 are secured to side walls 34, 36 and extend outwardly to parallel, outboard edges 60*a*, 62*a*, respectively. These parallel edges are spaced from each other a distance b, shown in FIG. 2, which distance is substantially greater than the distance a of the existing fireplace cavity B. Since face plates 60, 62 are secured to side walls 34, 36 at a position rearward of edges 40, 42, walls 34, 36 include extending portions or extensions 70, 72, respectively. Consequently, charging opening 50 is spaced outwardly from structural wall C.

Figure 1:
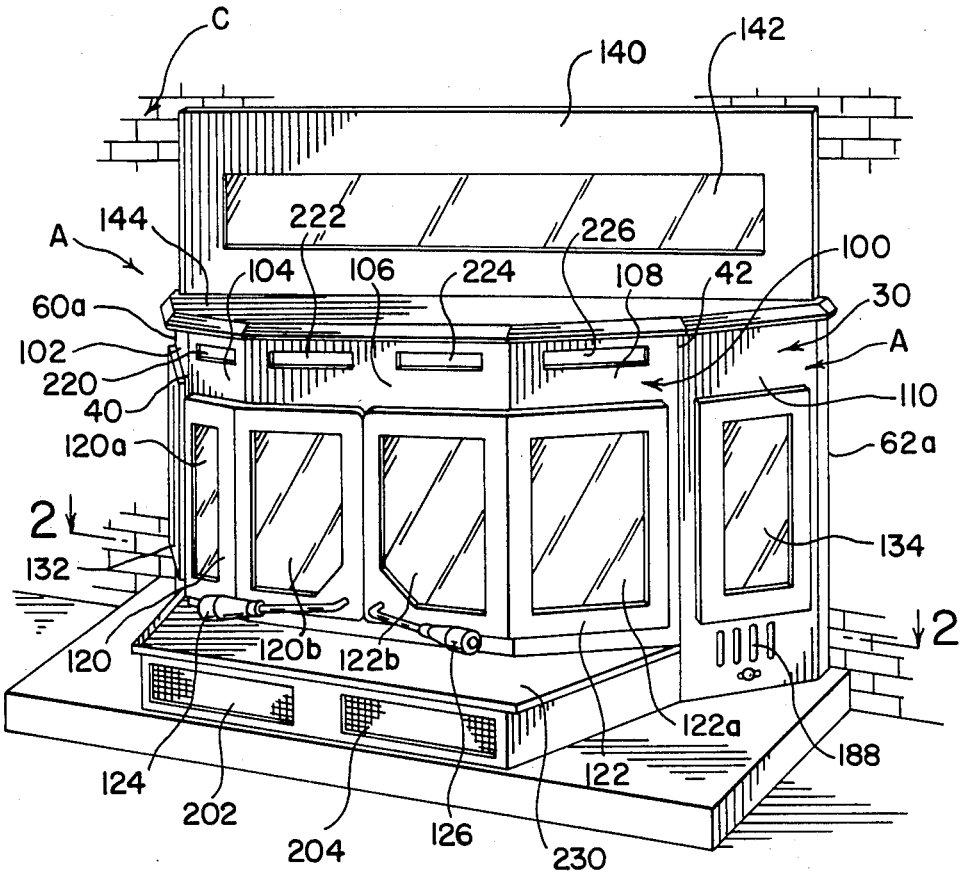
FIG. 1 is a pictorial view of the preferred embodiment of the present invention.

Parallel edges 40, 42 and outboard edges 60*a*, 62*a*, define support portions for an outwardly protruding, generally convex exposed front wall 100, as shown in FIGS. 1 and 2. This front wall or cover is formed along a path including edge 60*a*, edge 40, edge 42, and edge 62*a*. In the preferred embodiment of the invention, the path includes several flat portions 102, 104, 106, 108 and 110. As can be seen, the outwardly exposed front wall 100 produces a continuous wall structure extending outwardly from structural wall C and generally covering the total insert A between its parallel outboard edges 60, 62. This cover allows for a large charging opening 50 that has the appearance of a fireplace, instead of the structure or appearance of a standard fireplace insert. By appropriately welding cover 100 at these parallel edges, the insert is rigid, self-standing, and self-supporting and forms an extension of the receptor fireplace. Permanently angled door sections 120, 122 are provided with transparent panels 120*a*, 120*b* and 122*a*, 122*b*. Consequently, the interior or the fire box of the fireplace insert is viewable from the transparent partitions in the fixedly angled door sections 120, 122. By using the fixed angled doors, the fire can be seen from each side to enhance the enlarged portions of the fire box. These door sections include standard handles 124, 126 and are pivotally mounted about axes 128, 130 to pivot outwardly, as shown in the phantom line of FIG. 2. Panels 132, 134 are optional and are preferably decorative to match the general appearance of transparent panels 120*a*, 120*b*, 122*a*, and 122*b*. Upstanding plate or bezel 140 is provided to close any portion of access opening 20 above the horizontal decorative mantle 144 of insert A. For the purposes of matching other portions of the new fireplace insert, a decorative panel 142 can be provided on plate or bezel 140. By merely moving insert A rearwardly into fireplace cavity B, the insert covers the access opening and provides a substitute fireplace structure. Of course, the dimensions of the various sheet metal walls are such that the insert can be mounted in fireplace cavity B having a plurality of dimensions.

Figure 3:
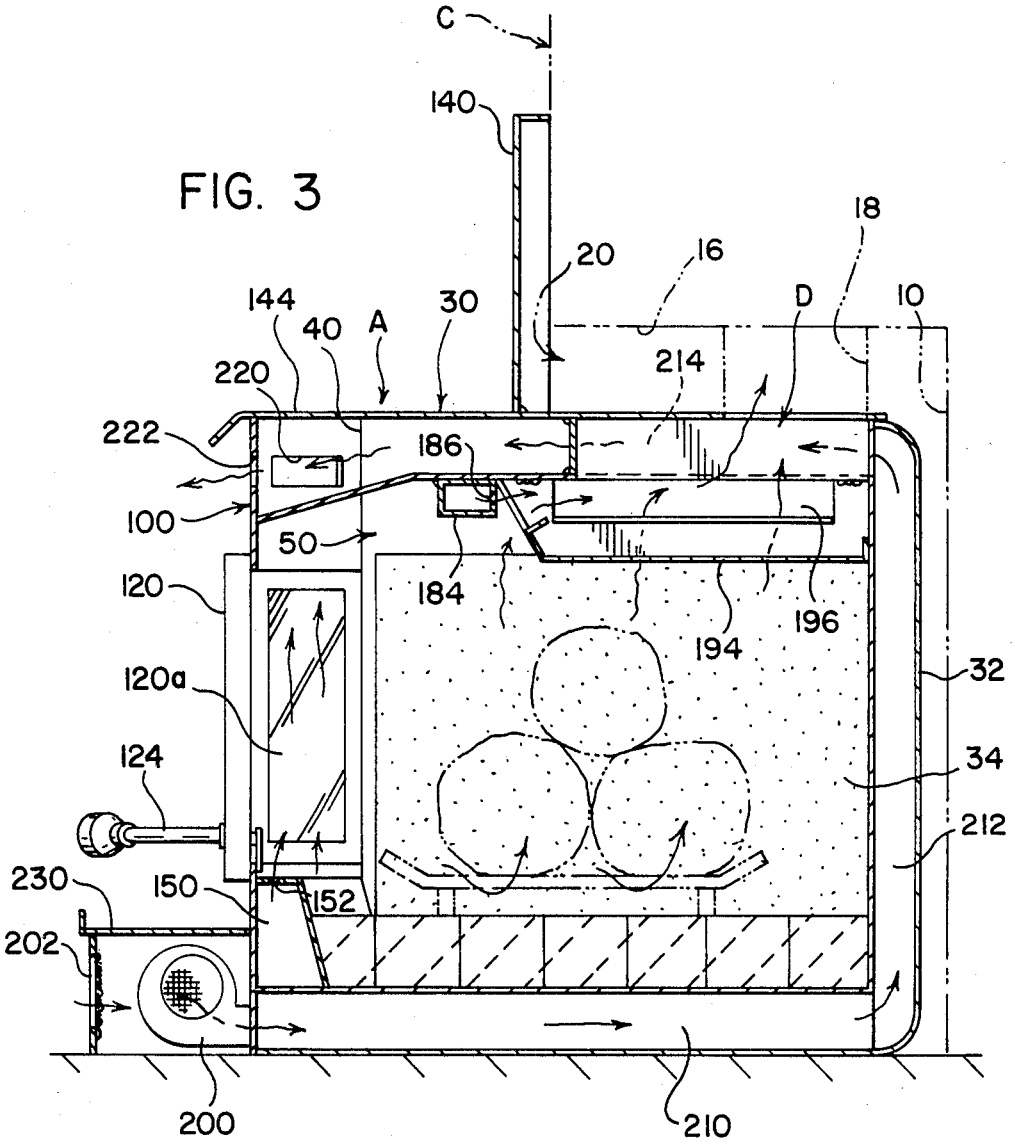

In accordance with another aspect of the present invention, a gas manifold 150 is provided along the inside portion of cover 100 at an angled door sections 120, 122. A plurality of upwardly directed orifices 152 cause jets of air to flow upwardly along the door section to prevent accumulation of soot. This feature is particularly useful when transparent panels are provided for the door section, which is the situation in the preferred embodiment. A blower 160 forces air through inlet 162 into manifold 150 for the purposes of providing the upwardly cleansing air jets. This air can be used as primary air for combustion. Blower 160 and air inlet 162 are provided in compartment 170 which, in accordance with the present invention, is provided between the diverging side wall 34, face plate 60 and outer cover 100. Compartment 170 allows for the mounting of the blower system without outward disclosure of such compartment. Although forced air may or may not be used for the primary and secondary air flows, a schematic illustration of primary and secondary air flows is disclosed for illustrative purposes. A blower 182 forces air into duct system 184 and air openings 186 therein provide secondary air in the area above a stainless steel plate 194, as shown in FIG. 3. Blower 182 and a part of duct system 184 is located in compartment 180, similar to compartment 170 previously described. These two outboard compartments may or may not be decorated on their outer surfaces for the purpose of blending in with the general appearance of the doors 120, 122. Blower 182 is shown as providing for secondary air flow.

In accordance with the illustrated embodiment, primary air flows along the directions represented by arrows 190, 192 and through openings 162, 188, respectively. These openings are also used for blowers 160, 182, as previously described. Openings in extensions 70, 72 allow flow of primary air (arrows 190, 192) into housing 30 and around plate 194 and through two lateral spaced openings, one of which is shown as opening 196 in FIG. 3. Other forms of primary and secondary air flows could be provided for the purpose of allowing more complete combustion of gases before these gases enter the flue D.

For the purposes of heating the room in which the insert is located a heat exchanger system is provided in insert A. This system includes a blower 200 for drawing air from inlets 202, 204 at the front of an ash tray 230. The lower duct 210 directs forced air along the bottom of the insert which may or may not have fire bricks as illustrated in FIG. 3. Air is then directed to a relatively large surface rear duct 212, best shown in FIG. 2, where the air absorbs heat from the burning material within the fire box of insert A. Large surface top ducts, one of which is shown as duct 214 in FIG. 3, direct the heated, forced air through exhaust openings 220, 222 on one side and 224, 226 on the other side into the surroundings. This heated air provides conventional heating and the outward protruding portion of insert A provides a radiant heat source.

Having thus defined the invention, the following is claimed:

1. In a conversion insert for an existing fireplace cavity having a back wall and outwardly extending lateral walls defining an access opening with a preselected width, said insert having a sheet metal housing with a rear wall, outwardly diverging, spaced side walls extending outwardly from said rear wall, said walls defining a stove portion with a charging opening therebetween, and a face plate extending transversely outwardly from said spaced side walls of said housing to form a closure over said access opening when said insert housing is positioned in said fireplace cavity, said face plate having outboard, generally parallel edges spaced from each other, the improvement comprising: side walls of said housing extending outwardly from said rear wall a substantial distance beyond said face plate whereby said charging opening of said insert housing and a portion of said stove portion are spaced outwardly from said face plate whereby said charging opening is generally between two outer edges of said side walls and is as large as said access opening of said fireplace cavity, and a pair of door members pivotally movable about the outer edges of said side walls, each of said door members including two generally planar portions with a fixed angle therebetween, said door members defining an outwardly protruding convex front wall having outwardly facing surfaces coplanar with said planar portions of said door members.

* * * * *